US005697238A

United States Patent [19]

Oike

[11] Patent Number: 5,697,238

[45] Date of Patent: Dec. 16, 1997

[54] KEY CYLINDER

[75] Inventor: Futoshi Oike, Zama, Japan

[73] Assignee: Nissan Motor Co., Ltd., Kanagawa-ken, Japan

[21] Appl. No.: 588,169

[22] Filed: Jan. 18, 1996

[30] Foreign Application Priority Data

Jan. 19, 1995 [JP] Japan ..... P07-6356

[51] Int. Cl.[6] ..... E05B 9/04

[52] U.S. Cl. ..... 70/373; 70/372; 70/449

[58] Field of Search ..... 70/373, 372, 448, 70/449, 367–370

[56] References Cited

U.S. PATENT DOCUMENTS

| | | | |
|---|---|---|---|
| 1,674,737 | 6/1928 | Page | 70/373 |
| 3,122,013 | 2/1964 | Jacobi | 70/455 |
| 3,520,161 | 7/1970 | Jacobi | 70/372 |
| 3,583,185 | 6/1971 | Jacobi | 70/455 |
| 4,349,722 | 9/1982 | Kurth et al. | 219/202 |
| 4,671,090 | 6/1987 | Masaki et al. | 70/455 |
| 4,927,993 | 5/1990 | Simmons | 219/201 |
| 5,316,364 | 5/1994 | Ohya | 296/146.5 |
| 5,467,618 | 11/1995 | Shieh | 70/33 |

FOREIGN PATENT DOCUMENTS 1-67267 4/1989 Japan .

*Primary Examiner*—Rodney M. Lindsey
*Assistant Examiner*—Tuyet-Phuong Pham
*Attorney, Agent, or Firm*—Lowe, Price, LeBlanc & Becker

[57] ABSTRACT

A key cylinder to be attached to an outer panel for a vehicle is provided. The key cylinder includes a cylinder body and a casing for accommodating the cylinder body therein. The casing has a drain hole formed at a lower portion thereof for discharging the water out of the casing and first and second swelling formed to project from a side wall thereof. Above the drain hole, the first swelling is formed so as to incline to an axial direction of the key cylinder. The lower end of the first swelling extends up to a lower part of the casing, apart from one end of the drain hole In the axial direction of the key cylinder. In operation, the water climbing down the side wall of the casing is guided by the first swelling and brought into the lower end of the first swelling. Consequently, without flowing up to the drain hole, the water can be prevented from sticking on the periphery of the drain hole.

8 Claims, 5 Drawing Sheets

KEY CYLINDER

BACKGROUND OF THE INVENTION

1. Field of the Invention

The present invention relates to a key cylinder which is to be attached to an outer panel constituting a door for a vehicle such as an automobile.

2. Description of the Related Art

In a prior art, Japanese Unexamined Utility Model Publication (kokai) No. 1-67267 discloses a key cylinder as shown in FIGS. 1 and 2. In FIG. 1, formed in an outer panel 1 having a not-shown outside handle attached is an opening 1*a* into which a key cylinder 2 is inserted. After being inserted, the key cylinder 2 is fixed to the outer panel 1 by engaging a plate-spring shaped retaining clip 8 in the key cylinder 2 behind the panel 1.

In the key cylinder 2, a cylinder body 5 is inserted into a casing 4 so as to rotate therein. The cylinder body 5 is provided with a keyhole 5*a* in which a plurality of tumblers 5*b*, 5*b* . . . are arranged to operate the cylinder body 5. In operation, when a not-shown key plate as a companion is inserted into the keyhole 5*a*, the tumblers 5*b*, 5*b* . . . go under the keyhole 5*a* thereby to enable the cylinder body 5 to rotate in the casing 4. While, when the key plate is drawn off the key cylinder 2, the tumblers 5*b*, 5*b* project in the keyhole 5*a* thereby to make it impossible to rotate the cylinder body 5. Further In the cylinder body 5, a lever 6 is arranged to rotate in response to the rotation of the cylinder body 5. On the other hand, the casing 4 is provided on an underside thereof with a drain hole 4*a* having a projection 4*b* formed in the vicinity of one end thereof on a vehicle's interior side so as to extend downwardly.

The reason why the drain hole 4*a* and the projection 4*b* are formed in the key cylinder 2 is as follows.

That is, providing that such a drain hole 4*a* is not provided in the casing 4, water invading through the keyhole 5*a* in a rainy day or in washing a car would collect in the casing 4 without being drained, so that the water will corrode or freeze the tumblers 5*b*, 5*b* thereby bringing the key cylinder 2 into an inoperable condition. On the contrary, with the arrangement having the drain hole 4*a* and the projection 4*b*, it is possible to drain the water through the drain hole 4*a* and to let the drained water fall through the projection 4*b*.

In the prior art key cylinder mentioned above, however, the water, which has entered in the panel 1 through the intermediary of the outside handle attached on the door or through a waist portion formed on the door, may travel from an upper part of the casing 4 to the periphery of the drain hole 4*a* via. a side wall of the casing 4. Consequently, the water may stick and freeze on the periphery of the drain hole 4*a*. In such a case, there would be caused a problem of interfering the movements of the tumblers 5*b*, 5*b*, whereby it will be impossible for a driver to insert the key plate into the keyhole 5*a*. In this connection, it should be noted that even a provision of the projection 4*b* cannot overcome the above problem since it is provided to merely facilitate the fall of water which has flown out of the drain hole 4*a* and the water, which has reached there via the side wall of the casing 4, still sticks on the periphery of the drain hole 4*a*.

SUMMARY OF THE INVENTION

It is therefore an object of the present invention to provide a key cylinder which is capable of preventing water climbing down a side wall of a casing of the key cylinder from sticking on a periphery of a drain hole formed on the underside of the casing.

The object of the present invention described above can be accomplished by a key cylinder to be attached to an outer panel constituting a door for a vehicle, the key cylinder comprising:

a cylinder body having a key mechanism installed therein; and a casing for accommodating the cylinder body therein, the casing being provided at a lower portion thereof with a drain hole for discharging water out of the casing and provided on a side wall thereof with a first swelling which projects therefrom;

wherein, in a side view of the key cylinder, the first swelling is arranged so as to incline to an axial direction of the key cylinder above the drain hole; and wherein the swelling is adapted so that a lower end thereof reaches up to a lower part of the casing and exists apart from one end of the drain hole in the axial direction of the key cylinder. With the arrangement mentioned above, the water climbing down the side wall of the casing is guided by the first swelling and brought into the lower end of the first swelling, which is apart from the drain hole. Consequently, without flowing up to the drain hole, the water can be prevented from sticking on the periphery of the drain hole.

In the present invention, preferably, the casing is provided with a downward projection which projects downwardly in the vicinity of one of respective ends of the drain hole in the axial direction of key cylinder, which one end is closer to the lower end of the first swelling than the other end. In such a case, it is possible to further prevent the water from sticking about the drain hole. Because, not only does the downward projection operate to facilitate a falling of the water flowing out of the drain hole, but operates to prevent the water which has arrived at the lower end of the first swelling, from flowing toward the drain hole.

More preferably, the lower end of the first swelling is arranged so as to extend up to the downward projection. In this case, the water climbing down the side wall of the casing can reach up to the downward projection whereby it becomes to be easy for the water to fall.

It is preferable that, in the axial direction of the key cylinder, the lower end of the first swelling is positioned to be closer to an interior of the vehicle than the drain hole. More preferably, a key cylinder further comprises a covering member for covering one of ends of the casing in the axial direction of the key cylinder, which one end is closer to the interior of the vehicle than the other end of the casing. Further, it is preferable that a lower part of the covering member at one of respective ends thereof in the axial direction of the key cylinder, which one end is closer to an exterior of the vehicle than the other end, is adapted so as to abut on the downward projection. With these arrangement that the present key cylinder includes, not only does the downward projection promote to drop the water, but operates as a stop for determining a position of the covering member in case of attaching it on the key cylinder, since the lower extension of the covering member abuts against the downward projection.

In the key cylinder mentioned above, it is preferable that, inside the outer panel, a supporting member is fixed to the outer panel, provided with a portion which is arranged in the vicinity of the downward projection and which is closer to an exterior of the vehicle than the downward projection. More preferably, the portion of the supporting member is arranged to overlap with the downward projection in the direction of height. In such cases, even when an external force is applied on the key cylinder, it is possible to restrict an oscillation of the key cylinder since the portion of the supporting member interferes with the downward projection.

Preferably, the casing is provided with a second swelling which is formed on the side wall of the casing circumferentially and which is arranged closer to an interior of the vehicle than the first swelling. Owing to a provision of the second swelling, it is possible to prevent the water climbing down from a top of the key cylinder from flowing to the direction toward the interior of the vehicle.

More preferably, the second swelling is connected with an lower end of the first swelling in the vicinity of the downward projection. Consequently, almost all the water flowing down from the top of the cylinder can be guided to the downward projection thereby to drop therefrom.

The above and other features and advantages of this invention will become apparent, and the invention itself will best be understood, from a study of the following description and appended claims, with reference had to the attached drawings showing a preferred embodiment of the invention.

DESCRIPTION OF THE PREFERRED EMBODIMENT

An embodiment of the present invention will be described with reference to FIGS. 3 to 8.

Figure 8:
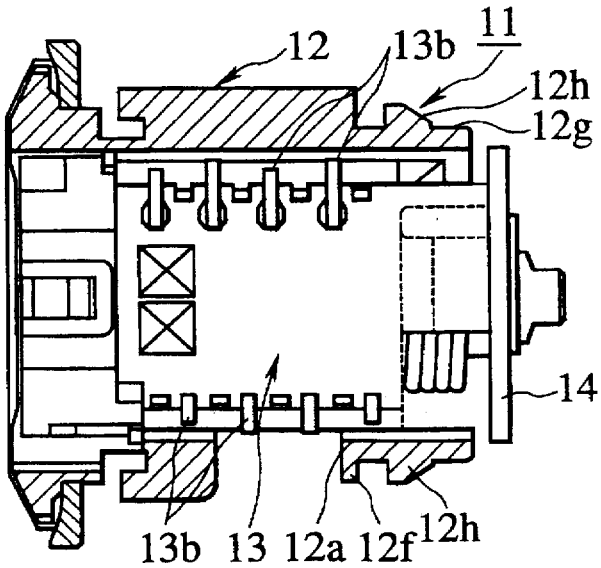
FIG. 8 is a cross sectional view of the key cylinder, taken along a line A—A of FIG. 7.

Referring to FIG. 8, reference numeral 1 designates an outer panel to which a not-shown outside handle is attached and which constitutes a door for a vehicle. Formed in the outer panel 1 is an opening 1*a* into which a key cylinder 11 of the invention is inserted. On condition that the key cylinder 11 is inserted into the opening 1*a*, the key cylinder 11 is fixed to the outer panel 1 by engaging a retaining clip 3, which is shaped of a plate spring, in the key cylinder 11 behind the panel 1.

In the key cylinder 11, a cylinder body 13 (FIG. 8) having a not-shown key mechanism installed therein is inserted into a casing 12 so as to rotate therein. Inside of the outer panel 1, a covering member 15 is attached to the casing 12 to cover an end 12*g* thereof which is closer to an interior (right hand of FIG. 3) of the vehicle than the opposite end of the casing 12.

In the same manner as the conventional key cylinder, the cylinder body 13 is provided with a keyhole which is not shown in the figure. In FIG. 8, arranged in the keyhole are a plurality of tumblers 13*b*, 13*b* . . . . which can go under the keyhole when a not-shown key plate is inserted into the keyhole, thereby allowing the cylinder body 13 to rotate in the casing 12. On the other hand, when the key plate is drawn off the key cylinder 11, the tumblers 13*b* are activated to project into the keyhole, so that it becomes impossible for the cylinder body 13 to rotate in the casing 12. Further arranged in the cylinder body 13 is a lever 14 which is adapted so as to rotate in response to the rotation of the cylinder body 13.

Figure 1:
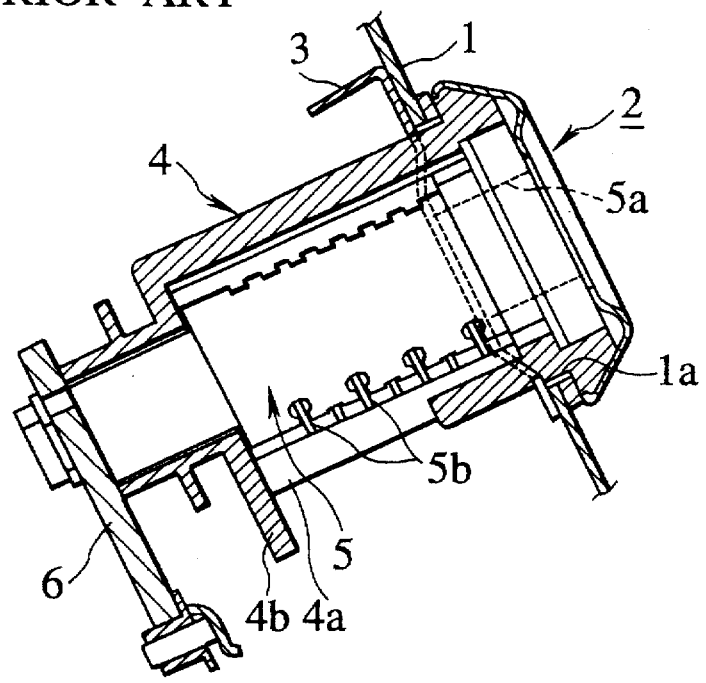
FIG. 1 PRIOR ART
FIG. 1 is a cross sectional view showing a conventional key cylinder attached to an outer panel of a door.
Figure 2:
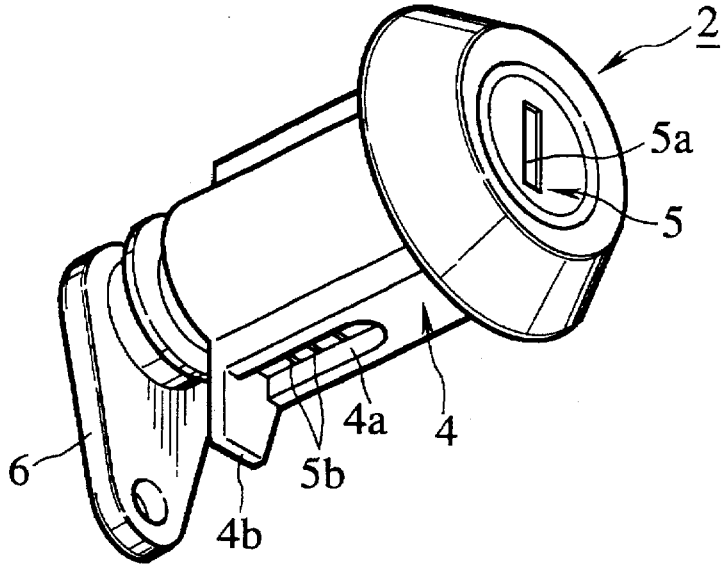
FIG. 2 PRIOR ART
FIG. 2 is a perspective view of the conventional key cylinder of FIG. 1.
Figure 3:
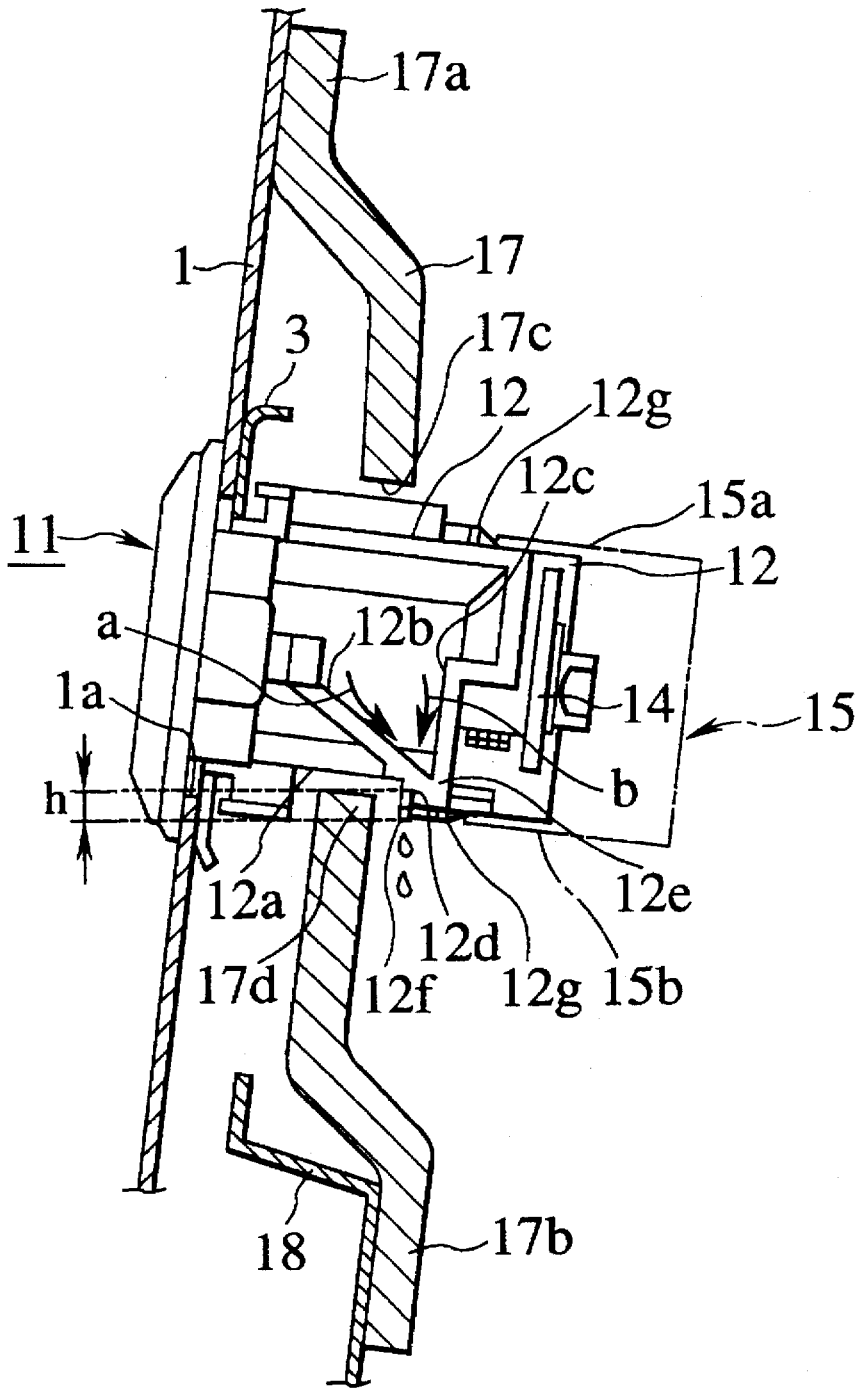
FIG. 3 is a cross sectional view showing a key cylinder in accordance with an embodiment of the present invention, which is attached to the outer panel of the door.
Figure 4:
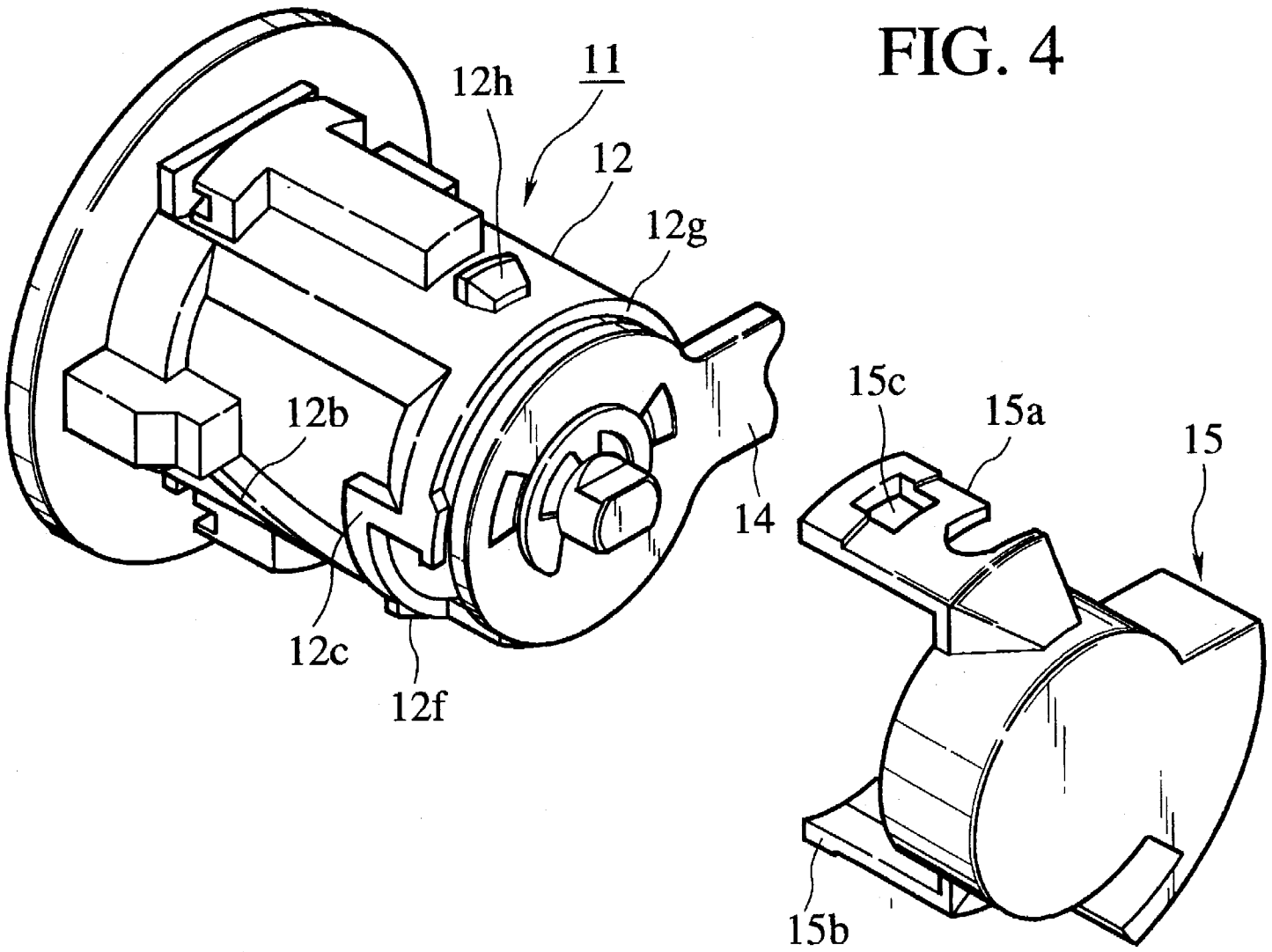
FIG. 4 is a perspective view showing the key cylinder of the embodiment shown in FIG. 3 in its disassembled condition.

As shown in FIGS. 8 and 4, the casing 12 is provided on an underside thereof with a drain hole 12*a*. In addition, the casing 12 is provided on a circumferential side wall thereof with first symmetrical swellings 12*b*, 12*b* and second symmetrical swellings 12*c*, 12*c* both of which project from the side wall. As will be apparent from FIG. 3, in a lateral view of the key cylinder 11, each of the first swellings 12*b* is shaped to incline to the axial direction of the key cylinder 1 as if to cross an upper side of the drain hole 12*a* obliquely. Further, each first swelling 12*b* is arranged so that a lower end 12*d* thereof extends up to a lower portion of the casing 12. As shown in FIG. 3, the lower end 12*d* is positioned on one side of the drain hole 12*a* in the axial direction of the key cylinder 11, which side is closer to an interior of the vehicle than the other side of the drain hole 12*a*.

Figure 5:
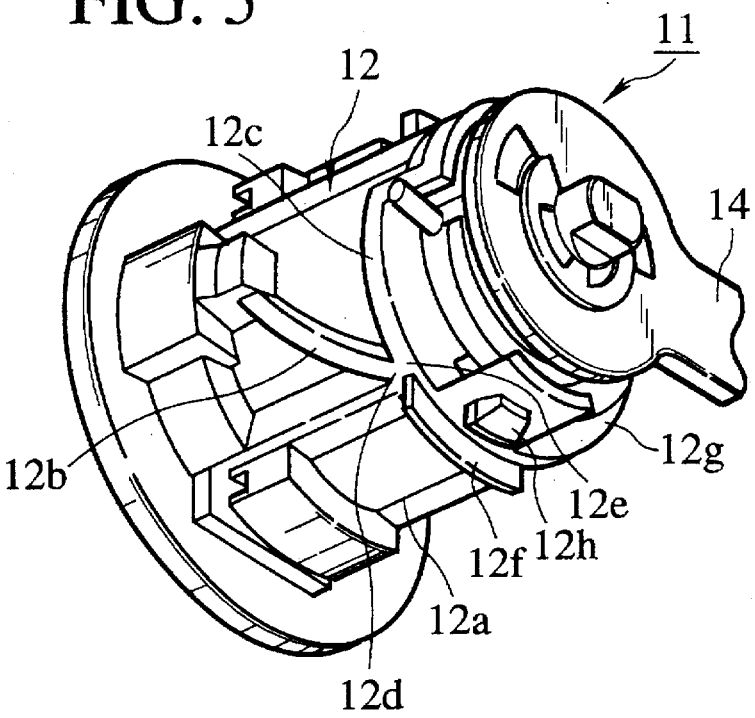
FIG. 5 is a perspective view of the key cylinder of the embodiment in its assembled condition, viewed from a slantwise underside thereof.
Figure 6:
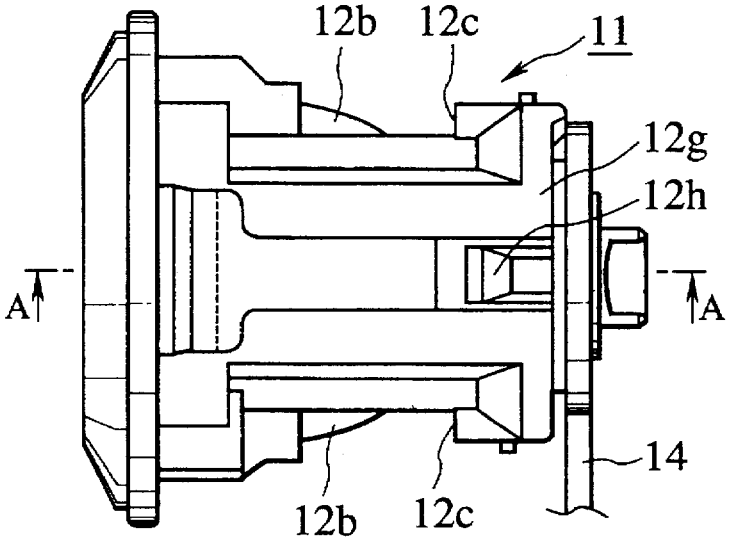
FIG. 6 is a plan view of the key cylinder of the embodiment.
Figure 7:
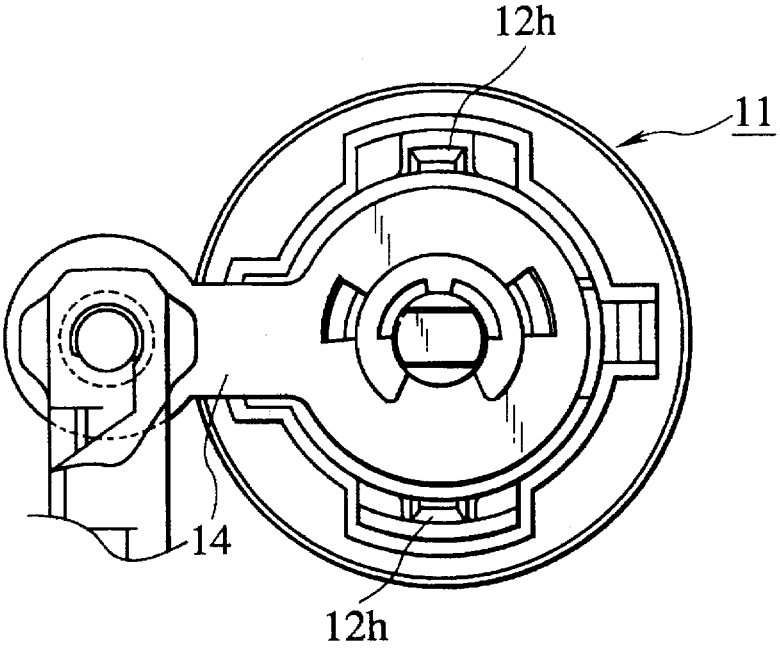
FIG. 7 is a side view of the key cylinder of the embodiment, viewed from a right side of FIG. 6.

As shown in FIGS. 3 to 5, the second swellings 12*c* are circumferentially formed on the side walls of the casing 12 so as to be closer to the lever 14 than the first swellings 12*b*. The second swellings 12*c* are arranged so that respective lower ends 12*e* thereof incorporate in the lower ends 12*d* of the first swellings 12*b*, respectively.

In the axial direction of the key cylinder 11, formed in the vicinity of an inside (i.e., a vehicle's interior side) end of the drain hole 12*a* is a downward projection 12*f* which extends downwardly and terminates in the lower ends 12*d*, 12*e* of the first and second swellings 12*b*, 12*c*. Hereat, it will be understood in FIG. 8 that each of the first swelling 12*b* is arranged so that the lower end 12*d* is apart from the inside end of the drain hole 12*a* by a width of the downward projection 12*f*.

The covering member 15 is constituted by a switch (key cylinder switch) for detecting a locked or unlocked condition of the key cylinder 11, having a detecting section covered. Being provided with an upper extension 15*a* and a lower extension 15*b*, the covering member 15 is so constructed as to be attachable to the inner end 12*g* of the casing 12. The upper and lower extensions 15*a*, 15*b* have respective engagement holes 15*c*, 15*c* in which engagement projections 12*h*, 12*h* formed on the casing 12 are to be engaged respectively. Furthermore, the covering member 15 is adapted so that, under condition that it is attached to the key cylinder 11, a tip of the lower extension 15*b* is brought into contact with the downward projection 12*f* of the casing 12.

Inside the outer panel 1, a plate-shaped supporting member 17 is arranged so that an upper end 17*a* thereof is secured to a mounting part of the not-shown outside handle while a lower end 17*b* is fixed to a door-guard bar 18.

The supporting member 17 is provided with a through hole 17*c* into which the so-constructed key cylinder 11 is inserted. The through hole 17*c* is positioned so that a lower margin 17*d* thereof is in the vicinity of the downward projection 12*f* and on a vehicle-exterior's side thereof while overlapping with the downward projection 12*f* in a span of (h) in FIG. 3 in a direction of the height.

The key cylinder 11 of the invention operates as follows.

The water entering through the keyhole 5a in a rainy day and during washing the car and water condensed in the casing 4 will be drained through the drain hole 12a and thereafter, the water is dropped by the downward projection 12f.

On the other hand, the water entering in the panel 1 through the intermediary of the outside handle and/or the waist portion on the door, will flow from the upper part of the casing 12 toward the lower part through the intermediary of the side walls. Then, as shown with arrow a of FIG. 3, being guided by the slanted first swelling 12b without reaching the drain hole 12a, the water climbing down each side wall of the casing 12 is brought into the lower end 12d arranged apart from the drain hole 12a. Consequently, the sticking of water on the periphery of the drain hole 12a and the resulting freezing can be prevented thereby to exclude an interruption of the water for movements of the tumblers 13b, 13b in the cylinder body 13.

In addition, owing that the lower ends 12 of the first swellings 12b are connected to the downward projection 12f, since the water guided up to the lower ends 12d falls through the downward projection 12f together with the water flowing out of the drain hole 12a, it is possible to further prevent the water from sticking about the drain hole 12a. In other wards, not only does the downward projection 12f operate to facilitate a falling of the water flowing out of the drain hole 12a, but the downward projection 12f interrupts a flowing of the water, which has arrived at the lower ends 12d of the first swellings 12b, toward the drain hole 12a.

Further, according to the embodiment, since the second swellings 12c are formed so that the lower ends 12e extends up to the downward projection 12f, the water climbing down from the top of the key cylinder 11 is guided as shown with arrow b of FIG. 3. Thus, the flowing of water toward the vehicle interior side of the cylinder 11 can be prevented thereby to allow almost all the water flowing from the top of the key cylinder 11 to lead to the downward projection 12f and drop therefrom.

Not only does the downward projection 12f promote to drop the water, but the downward projection 12f operates as a stop for determining a position of the covering member 15 in case of attaching it on the key cylinder 11 since the lower extension 15b of the covering member 15 abuts against the downward projection 12f. Therefore, with the arrangement, it is possible for an operator to attach the covering member 15 easily and precisely.

As mentioned above, the lower margin 17d of the supporting member 17 is arranged to overlap with the downward projection 12f of the key cylinder 11 in the direction of height. Thus, even when an external force is applied on the key cylinder 11, it is possible to restrict an oscillation of the key cylinder 11 since the lower margin 17d interferes with the downward projection 12f. That is, it means that it is possible to prevent an undesirable opening of the locked condition due to the oscillation of the key cylinder 11, so that it is effective for an antitheft lock.

Although the first swellings 12 are shaped so as to be convex in the above mentioned embodiment, it may be applicable that the lower part of the key cylinder 11 is so formed as to merely swell in a step-manner in comparison with the upper part of the key cylinder 11 in a modification.

Finally, it will be understood by those skilled in the art that the foregoing description is one of preferred embodiments of the disclosed key cylinder, and that various changes and modifications may be made to the present invention without departing from the spirit and scope thereof

What is claimed is:

1. A key cylinder structure, said key cylinder structure comprising:

an outer panel constituting a door of a vehicle which has an interior and an exterior; and a key cylinder attached to said outer panel, said key cylinder including a cylinder body having a key mechanism installed therein and a casing for attachment to said door and accommodating said cylinder body, said casing having a lower portion provided with a drain hole for discharging water out of said casing and provided on a side wall thereof with a first swelling which projects therefrom, wherein, in a side view of said key cylinder, said first swelling extends in an axial direction of said key cylinder so as to incline to the axial direction of said key cylinder above said drain hole, said first swelling being arranged to extend angularly in an axial, side by side direction with said drain hole, and wherein said first swelling is provided a lower end reaching to a lower part of said casing and said lower end exists apart from one end of said drain hole in the axial direction of said key cylinder.

2. The key cylinder structure according to claim 1, wherein:

said casing is provided with a downward projection which projects downwardly in the vicinity of said one end of said drain hole in the axial direction of said key cylinder, which one end is closer to said lower end of said first swelling than is an opposite end.

3. The key cylinder structure according to claim 2, wherein:

said lower end of said first swelling is arranged so as to extend to the downward projection.

4. The key cylinder structure according to claim 3, wherein:

in the axial direction of said key cylinder, said lower end of said first swelling is positioned to be closer to said interior than said drain hole.

5. The key cylinder structure according to claim 4, further comprising:

a covering member for covering a first end of said casing in the axial direction of said key cylinder, said first end being closer to said interior than a second end of said casing, wherein a lower part of said covering member, at one end is closer in said axial direction to said exterior than is another end which abuts on said downward projection.

6. The key cylinder structure according to claim 2, wherein:

said outer panel is provided with a supporting member fixed inside, and the supporting member has a portion arranged in the vicinity of said downward projection and closer to said exterior than said downward projection, and wherein said portion of said supporting member overlaps with said downward projection in a vertical direction of height.

7. The key cylinder structure according to claim 2, wherein:

said casing is provided with a second swelling which is formed on the side wall of said casing circumferentially and is arranged closer to an interior of said vehicle than said first swelling.

8. The key cylinder structure according to claim 7, wherein:

said second swelling is connected with a lower end of said first swelling in the vicinity of said downward projection.

* * * * *